US010478860B2

(12) United States Patent
Schaefer et al.

(10) Patent No.: US 10,478,860 B2
(45) Date of Patent: Nov. 19, 2019

(54) DEVICE AND METHOD FOR THE FLEXIBLE CLASSIFICATION OF POLYCRYSTALLINE SILICON FRAGMENTS

(75) Inventors: Marcus Schaefer, Traunstein (DE); Reiner Pech, Neuoetting (DE)

(73) Assignee: WACKER CHEMIE AG, Munich (DE)

( * ) Notice: Subject to any disclaimer, the term of this patent is extended or adjusted under 35 U.S.C. 154(b) by 2747 days.

(21) Appl. No.: 12/296,219

(22) PCT Filed: Mar. 28, 2007

(86) PCT No.: PCT/EP2007/052969

§ 371 (c)(1),
(2), (4) Date: Dec. 11, 2008

(87) PCT Pub. No.: WO2007/115937

PCT Pub. Date: Oct. 18, 2007

(65) Prior Publication Data

US 2009/0120848 A1 May 14, 2009

(30) Foreign Application Priority Data

Apr. 6, 2006 (DE) ..... 10 2006 016 324

(51) Int. Cl.

| | |
|---|---|
| ***B07B 1/28*** | (2006.01) |
| ***B07B 1/00*** | (2006.01) |
| ***B07B 13/00*** | (2006.01) |
| ***B07B 13/04*** | (2006.01) |

(52) U.S. Cl.
CPC ..... *B07B 1/00* (2013.01); *B07B 13/003* (2013.01); *B07B 13/04* (2013.01)

(58) Field of Classification Search
CPC ..... B07B 1/00
USPC ..... 209/577
See application file for complete search history.

(56) References Cited

U.S. PATENT DOCUMENTS

| | | | | |
|---|---|---|---|---|
| 2,612,997 | A * | 10/1952 | Harvengt | 209/457 |
| 4,384,957 | A * | 5/1983 | Crowder et al. | 210/656 |
| 4,492,629 | A * | 1/1985 | Dumbaugh | 209/332 |
| 4,583,695 | A | 4/1986 | Genestie | |
| 4,795,651 | A * | 1/1989 | Henderson et al. | 426/456 |
| 4,871,117 | A * | 10/1989 | Bauereggger | B02C 19/186 241/15 |
| 5,165,548 | A * | 11/1992 | Dumler et al. | 209/2 |
| 5,199,574 | A * | 4/1993 | Hollyfield et al. | 209/315 |
| 5,263,591 | A * | 11/1993 | Taormina et al. | 209/630 |

(Continued)

FOREIGN PATENT DOCUMENTS

| | | |
|---|---|---|
| DE | 4113093 A | 10/1991 |
| DE | 43 21 261 A1 | 2/1994 |

(Continued)

OTHER PUBLICATIONS

Patent Abstract of JP57067019A.

*Primary Examiner* — Jacob S. Scott
*Assistant Examiner* — Michael E Butler
(74) *Attorney, Agent, or Firm* — Brooks Kushman P.C.

(57) ABSTRACT

Polycrystalline silicon fragments are sorted into defined particle fractions in a flexible manner independent of initial particle size distribution and desired fraction size by a first mechanical screening into a fine fraction and residual fraction, followed by optoelectronic sorting of the residual fraction.

23 Claims, 3 Drawing Sheets

(56) References Cited

U.S. PATENT DOCUMENTS

| | | | | |
|---|---|---|---|---|
| 5,577,671 | A * | 11/1996 | Seppanen et al. | 241/14 |
| 5,699,724 | A * | 12/1997 | Wettstein et al. | 99/489 |
| 5,887,073 | A * | 3/1999 | Fazzari et al. | 382/110 |
| 5,921,401 | A * | 7/1999 | Johnston | 209/315 |
| 5,941,395 | A * | 8/1999 | Aho et al. | 209/314 |
| 6,040,544 | A * | 3/2000 | Schantz et al. | 209/577 |
| 6,265,683 | B1 * | 7/2001 | Flottmann et al. | 209/576 |
| 6,319,469 | B1 * | 11/2001 | Mian et al. | 422/64 |
| 6,375,011 | B1 * | 4/2002 | Flottmann et al. | 209/261 |
| 6,460,788 | B1 * | 10/2002 | de Feraudy | 241/19 |
| 6,767,706 | B2 * | 7/2004 | Quake et al. | 435/6.13 |
| 6,829,753 | B2 * | 12/2004 | Lee et al. | 716/30 |
| 6,874,713 | B2 | 4/2005 | Arvidson et al. | |
| 7,258,774 | B2 * | 8/2007 | Chou et al. | 204/450 |
| 7,351,929 | B2 * | 4/2008 | Afsari et al. | 209/580 |
| 2002/0048531 | A1 * | 4/2002 | Fonash et al. | 422/68.1 |
| 2003/0159647 | A1 * | 8/2003 | Arvidson | C30B 15/02 117/30 |
| 2003/0183705 | A1 * | 10/2003 | Christiani et al. | 241/23 |
| 2004/0025619 | A1 | 2/2004 | Nakamura et al. | |
| 2005/0242006 | A1 * | 11/2005 | Bohlig et al. | 209/659 |
| 2006/0081514 | A1 * | 4/2006 | Kenny | 209/672 |
| 2007/0187035 | A1 * | 8/2007 | To et al. | 156/344 |
| 2007/0235574 | A1 | 10/2007 | Schaefer et al. | |
| 2008/0024858 | A1 * | 1/2008 | Kaufman et al. | 359/315 |
| 2008/0277319 | A1 * | 11/2008 | Wyrsta | 209/166 |

FOREIGN PATENT DOCUMENTS

| | | | |
|---|---|---|---|
| DE | 197 19 698 | A1 | 11/1998 |
| EP | 0876851 | A | 11/1998 |
| EP | 1043249 | A | 10/2000 |
| EP | 1043249 | B | 11/2001 |
| EP | 1338682 | A | 8/2003 |
| EP | 1391252 | A | 2/2004 |
| EP | 1334907 | B | 4/2004 |
| EP | 1553214 | A | 7/2005 |
| JP | 57188430 | A2 | 11/1982 |
| JP | 10314680 | A2 | 12/1998 |
| JP | 2000088537 | A2 | 3/2000 |
| JP | 2000313513 | A2 | 11/2000 |
| JP | 2007275886 | A2 | 10/2007 |

* cited by examiner

DEVICE AND METHOD FOR THE FLEXIBLE CLASSIFICATION OF POLYCRYSTALLINE SILICON FRAGMENTS

CROSS-REFERENCE TO RELATED APPLICATION

This application is the U.S. national phase of PCT Appln. No. PCT/EP20070/052969 filed Mar. 28, 2007 which claims priority to German application DE 10 2006 016 324.9 filed Apr. 6, 2006.

BACKGROUND OF THE INVENTION

1. Field of the Invention

The invention relates to a device and a method for the flexible classification of polycrystalline silicon fragments.

2. Description of the Related Art

High-purity silicon is produced by chemical vapor deposition of a highly pure chlorosilane gas onto a heated substrate. This creates polycrystalline silicon in the form of rods. These rods must be comminuted for further use. For example metal jaw or ball crushers, hammers or chisels are used as breaking tools. The polycrystalline silicon fragments thus obtained, referred to below as "poly fragments", are subsequently classified according to defined fragment sizes.

Various mechanical screening methods are known for the classification of poly fragments, for example from EP 1391252 A1, U.S. Pat. No. 6,874,713 B2, EP 1338682 A2 or EP 1553214 A2. Furthermore, EP 1043249 B1 discloses an oscillatory conveyor with classification. Owing to their mechanical operating principle, such screening systems only allow separation according to the particle size, but not accurate separation according to a respectively desired length and/or area. They do not allow flexible adjustment of the fraction limits without mechanical refitting.

Controlled separation according to length and/or area can be achieved by optoelectronic sorting methods. Such methods are known for polysilicon, for example from U.S. Pat. Nos. 6,265,683 B1 and 6,040,544. The methods described therein are however still limited to the separation of particular, previously known feed flows. Optoelectronic separation of polysilicon fragments is problematic, however, whenever there is a large fine component (>1 wt % fragments <20 mm) in the feed material, since this interferes considerably with the image recognition of larger fragments. With the known devices, it is therefore not possible for a wide variety of input fractions to be separated flexibly into a plurality of particle classes with high accuracy, with respect, for example, to length and/or area. Furthermore, no regulation is described which leads to an even more accurate sorting result.

SUMMARY OF THE INVENTION

It was an object of the invention to provide a device which allows flexible classification of crushed polycrystalline silicon (polysilicon) preferably according to length and/or area of the poly fragments. These and other objects have been achieved through the use of a mechanical screening system followed by an optoelectronic sorting system, the screening system separating the poly fragments into a fine silicon component, and the residual coarse silicon component being separated into further fractions optoelectronically.

DETAILED DESCRIPTION OF THE PREFERRED EMBODIMENTS

The invention thus relates to a device which is characterized in that it comprises a mechanical screening system and an optoelectronic sorting system, the poly fragments being separated into a fine silicon component and a residual silicon component by the mechanical screening system and the residual silicon component being separated into further fractions by means of an optoelectronic sorting system.

The device makes it possible to sort the poly fragments according to length, area, shape, morphology, color and weight in any desired combinations. The length of a fragment is defined here as the longest straight line between two points on the surface of a fragment. The area of a fragment is defined as the largest shadow area of the fragment as projected into a plane.

The sorting system preferably consists of a multistage mechanical screening system and a multistage optoelectronic sorting system.

Figure 1:
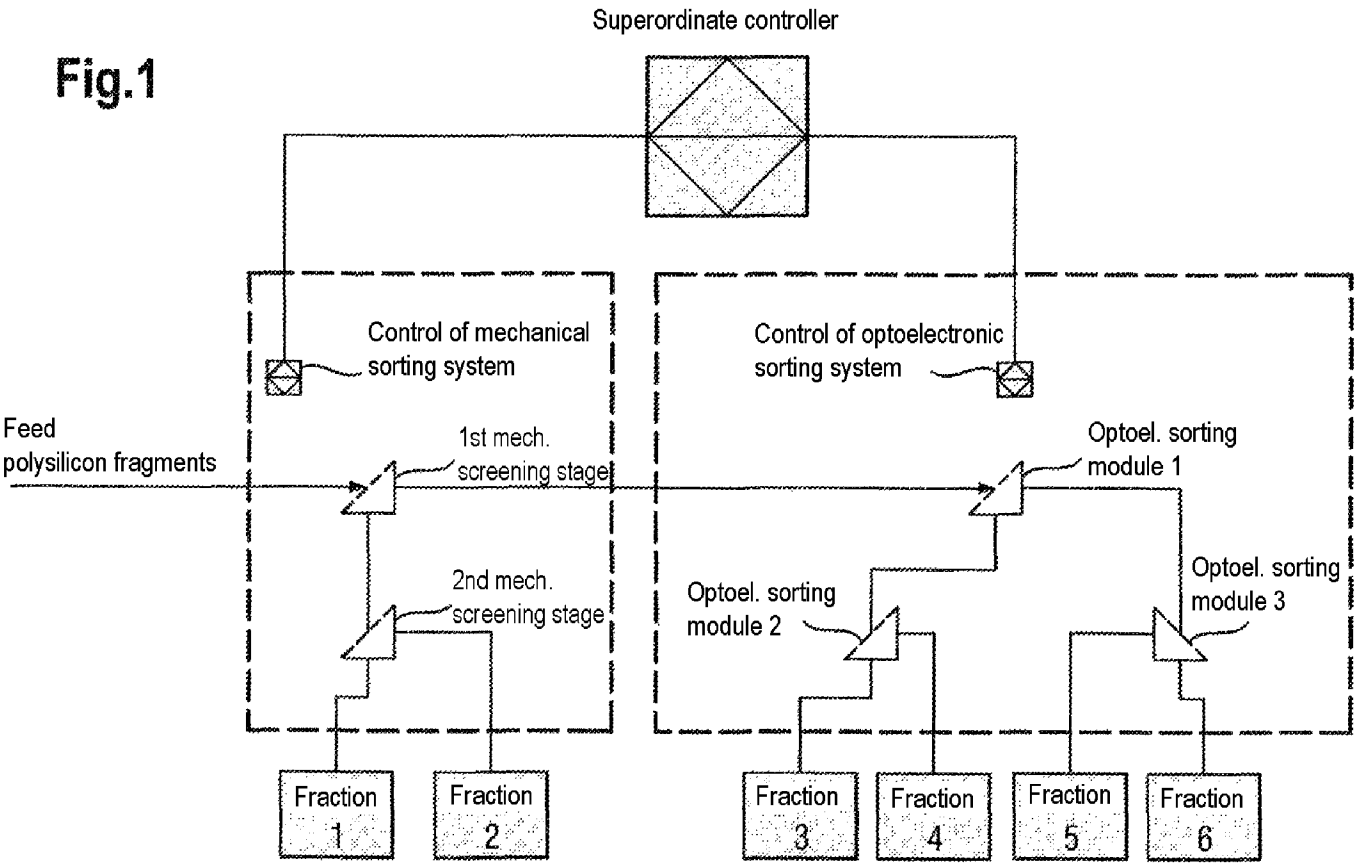
FIG. 1 illustrates the principle of the device used in the examples.

The mechanical and/or optoelectronic separating devices are preferably arranged in a tree structure (see FIG. 1). Arranging the screening systems and optoelectronic sorting system in a tree structure allows more accurate sorting compared with a series arrangement, since fewer separating stages need to be passed through and the quantity to be rejected in each separating module is less. The tree structure furthermore has shorter distances so that the wear on the system and the re-comminution of large fragments are less, and less contamination of the poly fragments takes place. All of this increases the economic viability of the device and the associated method.

Preferably, the fine component of the poly fragments to be classified is first separated from the residual silicon component by a mechanical screening system, and is subsequently separated into further fractions by a plurality of mechanical screening systems.

Any known mechanical screening machine may be used as a mechanical screening system. Oscillatory screening machines, which are driven by an unbalance motor, are preferably used. Mesh and hole screens are preferred as a screening surface. The mechanical screening system is used to separate fine components in the product flow. The fine component contains particle sizes up to a maximum particle size of up to 25 mm, preferably up to 10 mm. The mechanical screening system therefore preferably has a mesh width that separates said particle sizes. Since the mechanical screens at the start therefore only have small holes in order to be able to separate only the small fragments types (≤FS1), clogging of the screen rarely occurs which increases the productivity of the system. The problematic large poly fragments cannot stick in the small screen mesh widths.

The fine component may also be separated into further fractions by a multistage mechanical screening system.

The screening systems (screening stages) may be arranged serially or in another structure, for example a tree structure. The screens are preferably arranged in more than one stage, most preferably in three stages in a tree structure. For example, for intended separation of the poly fragments into four grain fractions (for example fractions 1, 2, 3, 4) fractions 1 and 2 are separated from fractions 3 and 4 in a first stage. Fraction 1 is then separated from fraction 2 in a second stage, and fraction 3 is separated from fraction 4 in a third stage arranged in parallel.

The residual polysilicon component may be sorted according to all criteria which constitute the prior art in imaging and sensor technology. Optoelectronic sorting is preferably used. It is preferably carried out according to one or more, more preferably from one to three of the criteria selected from the group length, area, shape, morphology, color and weight of the polysilicon fragments. It is most preferably carried out according to length and area of the polysilicon fragments. The residual silicon component is preferably separated into further fractions by one or more optoelectronic sorting systems. Preferably 2, 3 or more optoelectronic sorting systems, which are arranged in a tree structure, are used. The optical image recognition by the optoelectronic sorting system has the advantage that "true" lengths or areas are measured. This allows more accurate separation of the fragments according to the respectively desired parameters, compared with conventional mechanical screening methods. A device as described in U.S. Pat. No. 6,265,683 B1 or in U.S. Pat. No. 6,040,544 A is preferably used as the optoelectronic sorting system. Reference is therefore made to these documents in respect of the details of the optoelectronic sorting system. This optoelectronic sorting system comprises a device for dividing up the poly fragments and a sliding surface for the poly fragments, the angle of the sliding surface relative to the horizontal being adjustable, as well as a beam source through whose beam path the poly fragments fall and a shape recognition device that forwards the shape of the classified material to a control unit which controls a diverter device.

Preferably, in each optoelectronic sorting stage the product flow is divided up by an integrated oscillatory delivery trough and travels in free fall through a chute past one or more CCD color line cameras which carry out classification according to one or more sorting parameters selected from the group length, area, volume (weight), shape, morphology and color. As an alternative, all electronic sensor techniques known in the prior art may be used for the parameter recognition of the fragments. The measured values are communicated to the superordinate control and regulating instrument and evaluated for example by means of a microprocessor. By comparison with a sorting criterion stored in the formula, a decision is made as to whether a fragment is ejected from the product flow or let through. The ejection is preferably carried out by compressed air pulses through nozzles, the pressure being adjustable via the formula in the superordinate controller. In this case, for example, separating channels (compressed air arrays) are driven by a valve array arranged below the image recognition and receive dosed compressed air pulses which depend on the particle size.

The device according to the invention is therefore preferably provided with a superordinate controller that makes it possible for the sorting parameters according to which the poly fragments are sorted, and/or the system parameters which affect the delivery of the poly fragments (for example the delivery rate), to be adapted flexibly for the individual parts of the device. The sorting parameters, according to which the poly fragments are sorted, are preferably the aforementioned parameters, most preferably selected from the group length, area, morphology, color or shape of the fragments.

The superordinate controller preferably varies one or more of the parts of the device described below:

- the throughput of the delivery troughs (for example by varying the frequency of the unbalance motors);
- the oscillating frequency of the mechanical screens;
- the sorting parameters (limits for area, length, color or morphology, preferably length and/or area of the fragments); and
- the primary pressure at the ejection blower units.

The values of the sorting parameters, according to which the poly fragments are sorted, are preferably stored in the form of formulae in the superordinate controller, and the selection criteria in the mechanical screening device and/or the optoelectronic sorting are varied by selecting a formula, which then leads to application of the associated sorting parameters in the individual parts of the device according to the invention.

In a preferred embodiment, the device according to the invention comprises balances for determining the weight yields of the classified fractions after the sorting system. The device preferably comprises a fully automatic box filling and box transport device after the sorting system.

A preferred embodiment of the device is characterized in that the mechanical screening system and/or the optoelectronic sorting system are provided with a measuring instrument for defined parameters of the classified polysilicon fragments, and this measuring instrument is connected to a superordinate control and regulating instrument which statistically evaluates the measured parameters and compares them with predetermined parameters, and which in the event of a discrepancy between a measured parameter and a predetermined parameter can modify the setting of the sorting parameters of the optoelectronic sorting system or the entire sorting system (for example frequency of the mechanical screening system or delivery rates of the poly fragments) or the selection of the formula so that the parameter then measured approximates the predetermined parameter.

A parameter from the group of length, area, shape, morphology, color and weight of the polysilicon fragments is preferably measured. The length or area of the polysilicon fragments within the respective fraction is preferably measured and evaluated in the form of length or area distributions (for example 5%, 50% or 95% quantile). As an alternative, the weight yields of the individual screen fractions are determined by the balances at the screen outputs. A further measurement parameter is the mass and particle throughput as determined at the individual optoelectronic sorting systems.

In order to stabilize the desired yields, it is possible to employ either the weights of the individual fractions as recorded by a balance or the length distributions of the individual fragment fractions as measured in the optoelectronic separating system. If for example the amount of large fragments occurring is too great or the average length value (actual value) of the fragment distribution as determined at an optical separating stage is greater than the setpoint value, then separating limits may be moved according to logic established in the formula so that the fragment distribution is shifted toward the target.

If conversely the small fragment component is too large, then for example the delivery rates may be adapted with the aid of the measured particle number so as not to overload the system and/or another sorting formula may be selected.

The sorting parameters (for example average length value of a fraction) of the classified polysilicon fragments, determined for example in the optoelectronic sorting system in the scope of the on-line monitoring according to the sorting criteria (for example length distribution, weight distribution), are communicated to the superordinate control and regulating instrument and compared with predetermined setpoint values there. In the event of a discrepancy between the measured and predetermined parameters, the variable sorting parameters (for example the separating limits between two fractions or the mode of travel through the modules) are modified by the control and regulating instrument so that the measured parameter approximates the predetermined parameter.

The regulating instrument preferably regulates the separating limit between the fractions, the throughput via the delivery troughs or the pressure at the ejection blower nozzles.

In a variant of the device according to the invention, magnetic extractors (for example plate magnets, drum magnets or strip magnets) are arranged between the individual sorting stages in order to remove metal foreign bodies from the polysilicon fragments and reduce the metal contamination of the polysilicon fragments.

The control and regulating device preferably consists of a management system in the form of a memory-programmable controller (PLC) by which the controls of all subsystems (for example mechanical and optoelectronic sorting systems, automatic box processing with formula handling and handling of the control logic) are managed and regulated. The cross-subsystem display and operation are carried out by a superordinate management system. The error and operating messages of all subsystems are copied together in an error or operating message database, evaluated and displayed.

The combination of the individual systems to form the device according to the invention and the logic operations by means of a superordinate controller for the first time make it possible to carry out different sorting processes, i.e. sorting processes according to different sorting parameters, without requiring mechanical refitting of the device.

In particular, the device according to the invention allows flexible separation with a different particle size distribution of the feed material. Both very small (length <45 mm) and very large cubic fragments (length >45-250 mm) can be classified by simple software driving without mechanical refitting.

In the scope of the present invention, it has been established that the function of the optoelectronic sorting for any polysilicon fragments is made possible with the requisite accuracy only by preceding it with mechanical screening to separate the fine component. A high fine component in the feed material, which is fed to the optoelectronic sorting system, very greatly compromises the accuracy of the sorting and in the extreme case even compromises the optoelectronic sorting.

The device according to the invention allows a higher separating accuracy with respect to length and/or area of the fragments compared with a purely mechanical screening system. The device can be regulated by feedback of the sorting parameters (for example average value of the particle fractions (FS) measured in the optoelectronic screening system) as control variables for the sorting systems (for example separating limits at the individual optoelectronic sorting stages). The control and regulation can also be adapted via the formulae with the aid of the measured weight yields.

The device according to the invention allows on-line monitoring of the quality of the feed material (for example by statistical evaluation of the particle size distribution after crushing) according to the sorting criteria (for example length distribution, weight distribution).

The invention furthermore relates to a method in which poly fragments are classified by a device according to the invention.

To this end the poly fragments are preferably separated into a screened fine fraction and a residual fraction by a mechanical screening system, the screened fine fraction being separated into a fraction 1 and a fraction 2 by means of a further mechanical screening system and the residual fraction being separated into two fractions by means of optoelectronic sorting, these two fractions respectively being subdivided into 4 further target fractions (target fractions 3 to 6) by means of further optoelectronic sorting.

The method according to the invention has a high productivity, since the setup times are shorter than in known classification devices and clogging rarely occurs as with mechanical screens.

Preferably the screened fine fraction has a particle size of less than 20 mm, the residual fraction has a particle size of more than 5 mm, target fraction 1 has a particle size of less than 10 mm, target fraction 2 has a particle size of from 2 mm to 20 mm, target fraction 3 has a particle size of from 5 mm to 50 mm, target fraction 4 has a particle size of from 15 mm to 70 mm, target fraction 5 has a particle size of from 30 mm to 120 mm and target fraction 6 has a particle size of more than 60 mm.

The sorting parameters of the desired target fractions are preferably input into a superordinate control and regulating device, which carries out a corresponding adjustment of the parameters of the sorting systems in order to achieve the desired target fractions of the poly fragments. The adjustment of the parameters of the sorting systems is carried out as described for the device according to the invention.

Preferably, the fraction with the larger particle number in relation to the respective sorting parameter is respectively rejected or blown out in the optoelectronic sorting.

A pre-adjusted formula is preferably selected in the superordinate controller of the device according to the invention. All parameters of the sorting system and the manipulated variables of the regulation are stored in the formulae. The measurement of the product parameters and the classification of the polysilicon fragments are preferably carried out as described below:

The oversize of the first mechanical screening stage is sent to a multistage optoelectronic separating system. In each optoelectronic sorting stage, the product flow is divided up by an integrated oscillatory delivery trough and travels in free fall through a chute past one (or more) CCD color line camera(s) which carry out classification according to one or more of the parameters selected from the group length, area, volume (weight), shape, morphology and color in any desired combinations. As an alternative, all electronic sensor techniques known in the prior art may be used for the parameter recognition of the fragments. The measured values are communicated to the superordinate control and regulating instrument and evaluated for example by means of a microprocessor. By comparison with a sorting criterion stored in the formula, a decision is made as to whether a fragment is ejected from the product flow or let through. The ejection is preferably carried out by compressed air pulses through nozzles, the pressure being adjustable via the formula in the superordinate controller. In this case, for example, separating channels (compressed air arrays) are driven by a valve array arranged below the image recognition and receive dosed compressed air pulses which depend on the particle size. The transmitted flow and the rejected flow are discharged separately and sent to the next optoelectronic sorting stage. As an alternative, the ejection may also be carried out hydraulically or mechanically. Surprisingly, it has been found that a higher sorting accuracy is achieved by blowing out the fraction which is respectively smaller in respect of length, even though this fraction has a higher particle number. Specifically, it is to be expected from the prior art that the sorting accuracy decreases with an increasing reject component i.e. blowing out (hydraulically/mechanically removing) the "smaller" fraction in respect of particle number should lead to more accurate separation of the fragments. Surprisingly, however, more accurate separation of the fragments is achieved with the opposite approach in respect of lengths or area separation of the fragments.

The recognition by means of a sensor, preferably by means of optical image recognition, has the advantage that the "true" lengths, areas or shapes of the fragments are measured. On the one hand this allows more accurate separation, for example with respect to the length of the fragments, compared with conventional mechanical screening methods. The overlap between two fractions to be separated is smaller. On the other hand, the separating limits can be adjusted in any desired way via the predetermined parameters (the formula) of the superordinate controller, without having to carry out modifications on the machine itself (for example changing the screening surface). The inventive combination of a mechanical screen and an optoelectronic sorting system for the first time allows separation in both the small and large fragment size ranges, irrespective of the composition of the feed material.

The entire system may furthermore be regulated via the "on-line measurement", for example by correcting the separating limits directly according to the feed material.

The optoelectronic sorting in the device according to the invention furthermore offers the advantage that the combination of area and length allows more accurate separation of the fragments according to the respective requirements (for example high cubicity of the fragments).

The fractions of the silicon fragments as classified by means of the device according to the invention are collected and preferably loaded into boxes. The filling is preferably automated, as described for example in EP 1 334 907 B.

The following examples serve to explain the invention further.

The following fragment sizes of the poly fragments were produced in the examples:

FS 0: fragment sizes with a distribution of less than 5 mm

FS 1: fragment sizes with a distribution of about 2 mm to 12 mm

FS 2: fragment sizes with a distribution of about 8 mm to 40 mm

FS 3: fragment sizes with a distribution of about 25 mm to 65 mm

FS 4: fragment sizes with a distribution of about 50 mm to 110 mm

FS 5: fragment sizes with a distribution of about 90 mm to 250 mm.

The length data refer to the maximum length of the fragments, 85 wt % of the fragments having a maximum length within the specified limits.

Example 1

Polysilicon was deposited in the form of rods by the Siemens method. The rods were removed from the Siemens reactor and crushed to form coarse polysilicon fragments according to methods known in the prior art (for example by manual comminution). These coarse fragments with fragments having an edge length of from 0 to 250 mm were discharged through a feed device, preferably a funnel, onto a delivery trough which delivers the material to the device according to the invention.

The parameters for the fractions to be produced were input into the superordinate measurement and control device. Since the respective further use of the fragments to be produced dictates a respectively desired particle size distribution in each of the various fractions, the fractions are generally stored as formulae in the superordinate measurement and control device and are selected accordingly. In the present example, the device was used to produce 6 different fractions (FS 0, 1, 2, 3, 4, 5). All parameters of the optoelectronic and mechanical sorting systems and the delivery technique are respectively stored in the formulae.

For sorting poly fragments with large fragment components (FS 5), the following parameters were stored in the formula:

The fine component (FS 0 and 1) of the poly fragments was separated on the mechanical screen (sieve) with a mesh width of about 10 mm and the separated component was subsequently separated into FS 0 and 1 by a further mechanical screening system, i.e. a further screen with a mesh width of about 4 mm.

The coarse component (FS 2, 3, 4 and 5) was supplied to the optical sorting system via a delivery trough whose delivery characteristics, for example frequency, are likewise stored in the formula, and it was separated as follows by means of two tree levels i.e. three optical stages: in the first stage, FS 3&2 was separated from FS 4&5. A maximum length of 55 mm was stored in the formula as a separating limit. FS 3&2 was separated into FS 3 and 2 in a second stage, with a separating limit of 27 mm stored in the formula. FS 4&5 was separated into FS 4 and 5 in a third stage with a separating limit of 100 mm.

A higher sorting accuracy was achieved when the respectively smaller fraction with respect to length was blown out, even though this fraction had a higher particle number. For separating a feed material with a predominant weight component of FS5 and FS4, the largest fraction "FS2+FS3" in respect of particle number was blown out from the total fraction in the first module rather than the fraction "FS4+FS5". Similarly, the larger fraction "FS2" in respect of particle number was blown out from the mixture "FS2+FS3" rather than "FS3".

Magnets for extracting metallic contamination are installed between the various system parts, for example delivery troughs.

Figure 2:
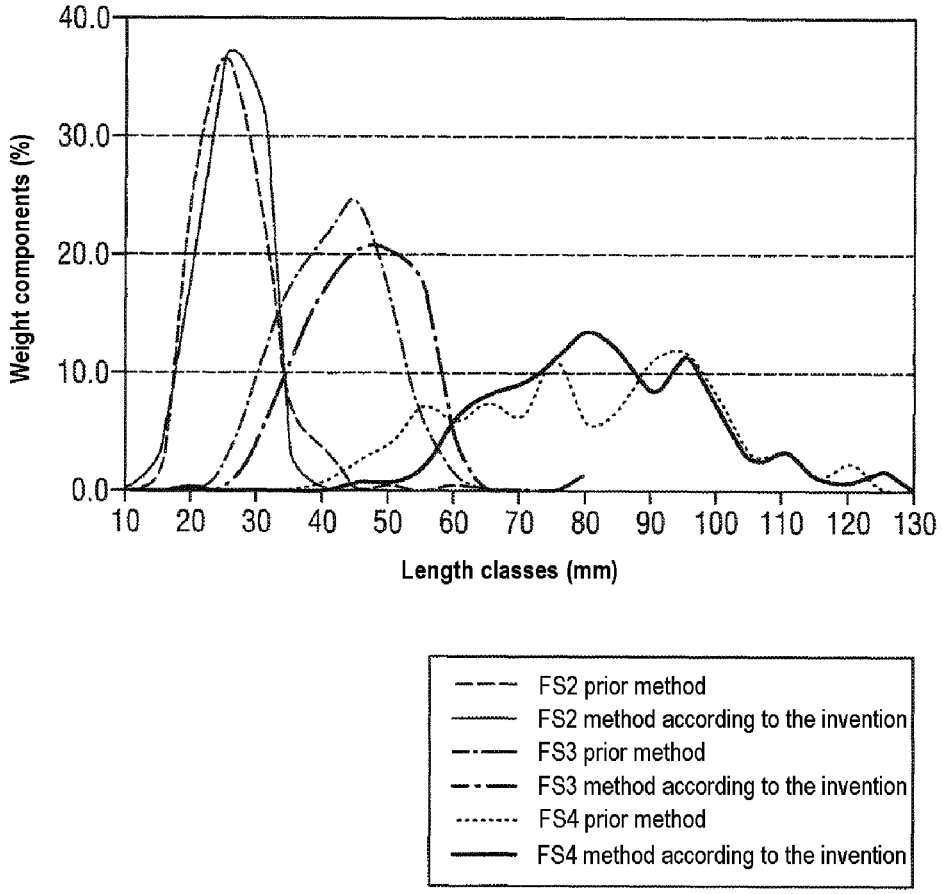
FIG. 2 illustrates one result of the sorting in Ex. 1 compared with optopneumatic separation by the same optopneumatic separating device without previous screening (prior art).

FIG. 2 shows the result of this classification in comparison with optopneumatic separation by the same optopneumatic separating device without previous screening. It may be seen clearly that the feed material could be sorted into the selected length classes. The more accurate separation (for example length) compared with conventional screening methods is visible. For example in the FS2/FS3 overlap with conventional separation, it can be seen that the FS2 distribution does not end until about 45 mm while the FS3 distribution already starts at 20 mm. The overlap is thus 25 mm. With the method according to the invention, the FS2 distribution already ends at about 40 mm while at the same time the FS3 distribution does not start until 25 mm. The overlap is therefore only 15 mm, and therefore 40% less than in the prior art.

Example 2

Figure 3:
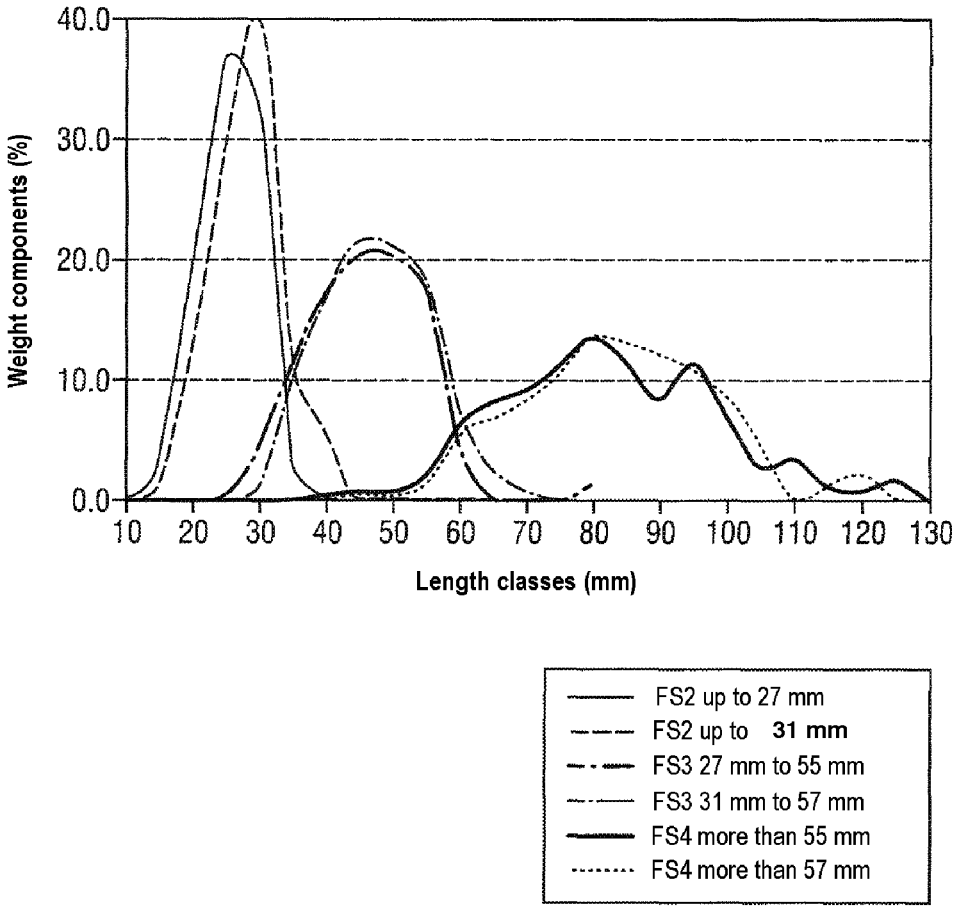
FIG. 3 illustrates the effect of the sorting limits set in the optoelectronic separating system (here the length of a fragment) on the fragment size distribution of the fractions thus obtained, as described in Ex. 2.

In order to stabilize the desired yields, the software parameters or separating limits of the individual fractions were varied slightly. In the formula for controlling the optoelectronic separating system, the values relating to maximum or minimum allowed length of the fragments in the individual fractions were changed by a few millimeters (see FIG. 3). Thus, the separating limit for blowing out between FS 2 and 3 was changed from 27 mm to 31 mm, and that between FS 3 and 4 was changed from 55 mm to 57 mm. This program parameter change of only a few millimeters is directly apparent in the product properties (for example length distribution), i.e. the separating limits between the individual fractions can be flexibly adapted with high accuracy to the respective specification by a simple formula selection, or they may be employed in the scope of the on-line regulation in order to achieve desired setpoint values.

Example 3

Classification of different particle size distributions of the poly fragments by means of a device according to the invention.

a) Sorting poly fragments with a main fraction >100 mm into 6 fractions (for example FS0 to FS5).

The fine component (<12 mm i.e. FS0+FS1) was first separated from the coarse fraction by mechanical sieving. This separated fraction was further divided by a subsequent second mechanical screen into the fractions FS0 and FS1. The coarse fraction (≥FS2) was sent to the optoelectronic sorting system and separated at a first separating stage (module 1, or first tree level) into a larger (≥FS4) and a smaller (≤FS3) fraction (separating limit FS3/FS4 between ~50 and 70 mm). These two fractions were respectively sent to a further separating stage (module 2 and module 3) in a second tree level and in turn separated into two fractions each. (Separating limit FS2/FS3 about 25 to 45 mm and FS4/FS5 about 85 to 120 mm). The fractions FS2, FS3, FS4 and FS5 were thus obtained. Further separating stages (or modules) may follow in third or higher tree levels, if separation into more or narrower fractions is desired.

b) Sorting poly fragments with a main fraction ~80 mm by separation into 5 fractions (FS0 to FS4).

α) The method corresponded to example 3a) with the difference that the module for the larger fraction in the second tree level was deactivated and the fraction ≥FS4 was not therefore further separated (blown out).

β) As an alternative, the mixture of FS2 to FS4 was separated in the first module into a fraction ≥FS3 and a fraction FS2. FS2 was not then further separated in the second tree level, while the fraction ≥FS3 was separated into the fractions FS3 and FS4 in the second level.

c) Sorting poly fragments with a main fraction ~45 mm by separation into 4 fractions (FS0 to FS3).

α) The separation of the fine component (FS0+FS1) was carried out similarly as in Ex 3a). The remainder, i.e. the mixture of FS2+FS3, was subsequently separated directly into FS2 and FS3 in the first optical module and the following deactivated modules in the second tree level were only passed through.

β) As an alternative, the first level (module) was deactivated and the separation FS2–FS3 was not carried out until the second tree level.

d) Sorting poly fragments with a main fraction ~25 mm by separation into 3 fractions (FS0 to FS2).

The separation of the fine component (FS0+FS1) was carried out similarly as in Ex 3a). The remainder, i.e. for example FS2, was let through the deactivated modules 1 and 2 i.e. not blown out in any tree level.

e) Sorting poly fragments with a main fraction <25 mm by separation into 2 fractions (FS0 and FS1).

The separation of the fine component (FS0+FS1) was carried out similarly as in Ex 3a). No material reached the optical sorting system.

The classifications a) to e) are possible with the same device according to the invention, without refitting of the device being necessary.

The invention claimed is:

1. A device for the classification of crushed polysilicon fragments comprising:
   a) a mechanical screening system comprising at least one screen having fine holes which removes fine polysilicon fragments from the screen through the holes and leaves a residual polysilicon component,
   b) an optoelectronic sorting system which classifies the residual polysilicon component into a plurality of fractions of different sizes.

2. The device of claim 1, wherein the screen has a screening surface wherein the fine holes are in the form of a mesh.

3. The device of claim 1, which comprises a multistage mechanical screening system with a plurality of screens in succession, each successive screen of the plurality of screens having a screening surface with smaller hole sizes as compared to a next prior screen, and a multistage optoelectronic sorting system.

4. The device of claim 1, wherein the mechanical and/or optoelectronic separating devices are arranged in a tree structure.

5. The device of claim 1, wherein the mechanical screening system comprises an oscillatory screen driven by an unbalance motor.

6. The device of claim 1, wherein the screens of the mechanical screening system are arranged in more than one stage.

7. The device of claim 1, wherein two optoelectronic sorting systems are used.

8. The device of claim 1, wherein three or more optoelectronic sorting systems are used.

9. The device of claim 1, further comprising a superordinate controller with adjustable sorting parameters according to which the polysilicon fragments are sorted, and/or adjustable system parameters which affect the delivery of the poly fragments, such that individual sorting stages of the device may be altered to provide at least one defined polysilicon fraction.

10. The device of claim 1, wherein at least one parameter according to which the polysilicon fragments are sorted is selected from the group consisting of length, area, morphology, color, and shape of the polysilicon fragments.

11. The device of claim 1, further comprising at least one oscillatory delivery trough, wherein following removal of fine silicon fragments, fragments which constitute the residual component are spatially separated from other fragments on the oscillatory delivery trough prior to classifying by an optoelectronic sorting system.

12. The device of claim 1 having a plurality of optoelectronic sorting stages, each stage immediately preceded by an oscillatory delivery trough which spatially separates fragments of the residual component prior to free fall through the respective optoelectronic sorting system.

13. The device of claim 1, wherein the superordinate controller varies one or more of:

the throughput of one or more delivery troughs;

the oscillating frequency of one or more mechanical screens;

the sorting parameters;

the pressure at ejection blower nozzles.

14. The device of claim 9, wherein the mechanical screening system and/or the optoelectronic sorting system are provided with a measuring instrument for at least one defined parameter of classified polysilicon fragments, this measuring instrument connected by means of the controller to a control and regulating instrument which statistically evaluates measured parameters and compares them with predetermined parameters, and which in the event of a discrepancy between a measured parameter and a predetermined parameter, varies the sorting parameters of the optoelectronic sorting system or the entire sorting system so that the parameter then measured approximates the predetermined parameter.

15. The device of claim 1, wherein at least one magnetic extractor is positioned between individual sorting stages.

16. A method for the flexible classification of crushed polysilicon comprising:

first classifying the crushed polysilicon with a mechanical screening system comprising at least one screen having fine holes, removing fine polysilicon fragments through the holes, and leaving a residual polysilicon component on the mechanical screening system; and classifying the residual polysilicon component from the mechanical screening system into a plurality of fractions of different fragment sizes by an optoelectronic sorting system.

17. The method of claim 16, further comprising classifying a fine fraction removed from the crushed polysilicon from the mechanical screening system into at least two fractions of different fragment sizes by at least one further mechanical screening system having a screen with holes.

18. The method of claim 16, wherein the residual component is first optoelectronically sorted into two fractions of different particle sizes, and the two fractions are further optoelectronically sorted into four fractions, each of the four fractions having different particle sizes.

19. The method of claim 16, comprising separating the fragments into a screened fine fraction and a residual component by a mechanical screening system having at least one screen with holes, classifying the screened fine fraction into a fraction 1, and a fraction 2 having a smaller fragment size than a fraction size of fraction 1, by means of a further mechanical screening system, and separating the residual component into two fractions by means of optoelectronic sorting, these two fractions respectively being subdivided into four further fractions 3 to 6 by means of further optoelectronic sorting.

20. The method of claim 19, wherein the screened fine fraction has particle sizes of less than 20 mm, the residual component has particle sizes of more than 5 mm, fraction 1 has particle sizes of less than 10 mm, fraction 2 has particle sizes of from 2 mm to 20 mm, fraction 3 has particle sizes of from 5 mm to 50 mm, fraction 4 has particle sizes of from 15 mm to 70 mm, fraction 5 has particle sizes of from 30 mm to 120 mm and fraction 6 has particle sizes of more than 60 mm, the particle sizes being a length which includes 85 weight percent of the particles in the respective fraction.

21. The method of claim 19, wherein the fraction with the larger particle number in relation to the respective sorting parameter is displaced pneumatically in response to optoelectronic sorting.

22. The method of claim 16, further comprising spatially separating fragments of the residual component from each other prior to the residual component entering the optoelectronic sorting system for classifying the residual component.

23. The method of claim 16, wherein more than one optoelectronic sorting stage is used, and a plurality of optoelectronic sorting stages are each preceded by an oscillatory delivery trough which spatially separates fragments delivered to the associated optoelectronic sorting stage prior to classification of the fragments by the associated optoelectronic sorting stage.

* * * * *